US005683567A

United States Patent [19]

Shimamune et al.

[11] Patent Number: 5,683,567

[45] Date of Patent: Nov. 4, 1997

[54] ELECTROLYTIC ELECTRODE AND METHOD OF PRODUCTION THEREOF

[75] Inventors: Takayuki Shimamune; Yasuo Nakajima, both of Tokyo, Japan

[73] Assignee: Permelec Electrode Ltd., Kanagawa, Japan

[21] Appl. No.: 374,092

[22] Filed: Jan. 18, 1995

Related U.S. Application Data

[62] Division of Ser. No. 91,044, Jul. 14, 1993, Pat. No. 5,431,798.

[30] Foreign Application Priority Data

Jul. 17, 1992 [JP] Japan ..... 4-213483

[51] Int. Cl.[6] ..... C25D 5/10

[52] U.S. Cl. ..... 205/171; 205/195; 205/220; 205/225; 205/917

[58] Field of Search ..... 205/170, 220, 205/225, 917, 171, 195; C25D 5/10

[56] References Cited

U.S. PATENT DOCUMENTS

| | | | |
|---|---|---|---|
| 4,040,939 | 8/1977 | Schenker et al. | 204/290 F |
| 4,064,035 | 12/1977 | Fukasawa | 204/290 R |
| 4,318,795 | 3/1982 | Bianchi et al. | 204/290 F |
| 4,510,034 | 4/1985 | Oshima et al. | 204/290 F |

FOREIGN PATENT DOCUMENTS

| | | |
|---|---|---|
| 1244650 | 9/1971 | United Kingdom . |
| 1277033 | 6/1972 | United Kingdom . |

*Primary Examiner*—Kathryn Gorgos

*Attorney, Agent, or Firm*—Sughrue, Mion, Zinn, Macpeak & Seas, PLLC

[57] ABSTRACT

The present invention relates to an electrolytic electrode comprising a core material made of a valve metal, a dense electrically conductive tin oxide layer formed on the core material, an α-lead dioxide layer formed on the tin oxide layer, and a β-lead dioxide layer formed on the α-lead dioxide layer. The present invention also relates to a method for preparing the electrolytic electrode.

2 Claims, No Drawings

ELECTROLYTIC ELECTRODE AND METHOD OF PRODUCTION THEREOF

This is a divisional of application Ser. No. 08/091,044 filed Jul. 14, 1993, now U.S. Pat. No. 5,431,798.

FIELD OF THE INVENTION

The present invention relates to an electrolytic electrode capable of electrolysis in an aqueous solution, in particular, an aqueous corrosive solution containing fluorine, and also to a method of producing the electrolytic electrode.

BACKGROUND OF THE INVENTION

Lead dioxide is a compound having a metallic electric conductivity. Since lead has excellent durability, lead dioxide is, in particular, very stable at an anodic polarization in an acidic bath and, furthermore, can be relatively easily produced by an electrodeposition method, etc. Lead dioxide has been widely used, for example, as an industrial electrolytic anode for the production of explosives such as peroxides, perchlorates, etc.; raw materials for oxidizing agents; syntheses of organic compounds; water treatment; etc.

By utilizing these characteristics, block lead dioxide electrodes were practically used in the 1940's. The electrode being used was formed by cutting a pot-form iron having a lead dioxide layer on the inside surface thereof by electrodeposition. However, the production thereof was very troublesome, and the production yield was bad; further, such an electrode had a brittleness specific to ceramics, and the specific gravity thereof was about 9, which was larger than that of iron, whereby the electrode was difficult to handle. Hence, the usable ranges of the electrodes were limited.

However, since titanium having an excellent corrosive resistance to anodic polarization in an acidic solution has been commercially used since the 1950's, the cost of titanium has lowered, and titanium is now used more in the chemical industries. For example, a light-weight and durable lead dioxide electrode composed Of the combination of titanium and lead dioxide has been produced, that is, an electrode composed of a titanium core having electrodeposited lead dioxide on the surface thereof. However, in the electrode, the interface between titanium as the core material and the lead dioxide layer was passivated by the strong oxidative power of lead dioxide, which sometimes resulted in making the passage of electric current impossible. Since electrically conductive titanium could not be used as the electrically conductive member, the lead dioxide layer itself was first used as the electrically conductive member. Thereafter, by spot-like welding platinum onto the surface of titanium to form an anchor, the electric conductivity was ensured.

Also, it became possible to obtain a good electric conductivity by applying a platinum plating to the whole surface of the titanium. However, this resulted in cracking the lead dioxide layer (and if a part of the lead dioxide layer was broken, platinum having a high activity to ordinary oxygen generation caused a reaction which peeled-off the lead dioxide layer).

The inventors previously solved the foregoing passivation problem by using semiconductive oxides of valve metals each having a different valent number. On the other hand, since the electrodeposition thickness of the lead dioxide layer on the surface of the core material was from 0.1 to 1 mm, which was thicker than the thickness of ordinary plating, the problem of peeling-off the coating by the electrodeposition strain could not be avoided. However, the problem is being solved by laminating or mixing α-lead dioxide and β-lead dioxide or by variously selecting other electrodepositing conditions. However, from the viewpoint of improving the corrosion resistance of lead dioxide, increasing the electrodeposition strain is desirable and, hence, corrosion resisting particles are dispersed in the β-lead dioxide layer, as disclosed in, for example, U.S. Pat. No. 4,822,459.

The lead dioxide electrode obtained by the steps described above was considered to be almost complete for an ordinary electrolytic reaction, but it was experienced that when the lead dioxide electrode was used in a fluoride-containing electrolyte containing fluorine ions or fluoride ions for a long period of time, cracks formed even though they were very slight and the electrolyte permeated through the cracks into the titanium portion of the ground, whereby corrosion resisting titanium was dissolved out.

As a countermeasure for the fluoride-containing electrolyte, it has been proposed that iron be used as the core material in place of titanium, strongly apply an intermediate coating thereto, and form a lead dioxide layer on the surface of the intermediate coating to constitute an electrode. However, once cracks form in such an electrode, the electrode is not sufficiently satisfactory since the corrosion resistance of iron as the core material is far inferior to that of titanium.

As described above, various investigations have been made on lead dioxide electrodes and various solving methods have been proposed but a lead dioxide electrode having a sufficient corrosion resistance and practical use to a fluoride-containing electrolyte, which is frequently used and is considered to be increasingly used hereafter, has not yet been realized.

SUMMARY OF THE INVENTION

The present invention solves the problems described above. Furthermore, an object of the present invention is to provide an electrolytic electrode giving a sufficient durability during electrolysis using various kinds of solutions, in particular, an aqueous solution containing fluorine ions or fluoride ions, and also to a method of producing the electrode.

Thus, according to one embodiment of the present invention, there is provided an electrolytic electrode comprising a core material made of a valve metal, a dense tin oxide layer rendered electrically conductive formed on the surface of the core material, an α-lead dioxide layer formed on the tin oxide layer, and a β-lead dioxide layer formed on the α-lead dioxide layer.

Also, according to another aspect of the present invention, there is provided a method of producing the electrolytic electrode, which comprises forming a tin plating layer on the surface of a core material (made of a valve metal), repeating the coating-oxidizing steps of a coating liquid containing an electrically conductive substance on the tin plating layer and oxidizing by thermal decomposition to convert the tin plating layer into a dense tin oxide layer rendered electrically conductive, forming an α-lead dioxide layer on the tin oxide layer, and then forming a β-lead dioxide layer on the α-lead dioxide layer.

DETAILED DESCRIPTION OF THE INVENTION

The present invention is described in detail below.

Since in the electrolytic electrode of the present invention, the core material is coated with the tin oxide layer and two lead dioxide layers, even when cracks form in the lead dioxide layers during electrolysis, the electrolyte scarecely reaches the core material. Thus, when the electrode of the present invention is used, in particular, in a fluoride-containing electrolyte having a high corrosive property, the electrode is maintained for a long period of time.

The electrode of the present invention can be produced as follows.

The core material of the electrode of the present invention may have a physical form-keeping function and function as an electrically conductive member. There is no particular restriction on the core material provided the material has these functions, and iron, stainless steel, nickel, etc., can be used. However, where the lead dioxide layers and the tin oxide layer are partially peeled-off or perforations form in the tin oxide layer (the thickness of which is frequently about 100 μm), for minimizing the damage thereof and in consideration of the durability to, in particular, fluorine ions, it is necessary to use a valve metal such as titanium, tantalum, niobium, etc., or an alloy thereof, which is very stable at an anodic polarization. In addition, the core material may have various forms such as a tabular form, a perforated form, an expand mesh, etc.

It is preferable to apply a sufficient ground treatment to the core material. Useful ground treatments include a method of increasing the surface area by a blasting treatment, a method of activating the surface by acid pickling, a method of carrying out a cathodic polarization in an electrolyte such as an aqueous sulfuric acid solution, etc., to generate a hydrogen gas from the surface of a substrate to carry out surface washing and carrying out an activation by a hydride partially formed by the hydrogen gas, etc., and by the ground treatment, pointed portions on the surface thereof can be removed. In a typical treatment condition, the core material is treated in an aqueous solution of 25% sulfuric acid at a temperature of from 80° to 100° C. for from 2 to 6 hours.

The core material is first plated with tin. There is no particular restriction on the tin plating condition, but for completely covering the core material with tin plating and thereafter carrying out a heat treatment, it is desirable to achieve a high cathodic current density such that gases are not contained in the plating layer. Typical plating baths are alkali baths and sulfuric acid baths. The alkali bath has a composition containing, for example, 105 g/liter of potassium stannate, 40 g/liter of tin, 15 g/liter of potassium hydroxide, and acetic acid. The sulfuric acid bath has a composition containing, for example, 40 to 50 g/liter of tin sulfate, 100 g/liter of sulfuric acid, 100 g/liter of cresolsulfonic acid, and other additives.

It is preferred that the current density at plating is from 1 to 2 A/dm$^2$ and the plating thickness is from 1 to 20 μm. If the plating thickness is less than 1 μm, the plating cannot completely cover the core material, while if the plating thickness is over 20 μm, a part of the tin remains in the tin plating layer as the liquid without being oxidized at the thermal decomposition, a liquid is formed at the course of the oxidation of the tin layer, and blister, etc., forms, whereby the tin layer is liable to be peeled-off.

Then, the tin layer is converted into a tin oxide layer. However, since by simply heating the tin layer, a volume expansion occurs and the tin oxide obtained does not have a sufficient electric conductivity when the temperature at the electrolysis is less than 100° C., the foregoing tin layer is impregnated with an electrically conductive substance by a thermal decomposition to convert the tin layer into a tin oxide layer having an electric conductivity and also the tin oxide layer is made dense.

As the conversion method, there is, for example, a method of coating an aqueous solution of a mixture of alkoxytin and platinum of about 10% thereof on the surface of a tin layer followed by burning in air at a temperature of from 300° to 500° C., and repeating the coating-burning steps 4 or 5 times to obtain a platinum-doped tin oxide layer. In this case, a nonvolatile salt such as tin oxalate can be used as a raw material for tin. Also, an aqueous solution containing antimony of from 5 to 40% of tin (in place of platinum) is prepared followed by thermal decomposition and, by repeating the coating and the thermal decomposition, a composite elecrically conductive oxide layer of substantially tin-antimony is formed. In this case, as tin and antimony, an alkoxytin and alkoxyantimony or tin oxalate and antimony oxalate may be used and the thermal decomposition temperature is from 300° to 500° C. In this case, since antimony is inferior in corrosion resistance to tin, it is preferred to use antimony in an amount of from 5 to 15% based on the total tin amount. Another method involves coating an aqueous solution of a mixture of titanium and tantalum on the surface of the foregoing tin layer followed by burning at a temperature of from 400° to 600° C. to give a semiconductivity by pentavalent tantalum, tetravalent titanium, and tin.

In any method described above, if the tin layer is oxidized with one coating, it sometimes happens that only the surface of the tin plating layer is oxidized and, on the inside thereof, is a liquid metal which breaks the coating. Therefore, it is necessary to coat the coating liquid and oxidize by burning 2 to 10 times.

Then, lead dioxide layers are formed on the tin oxide layer. When a β-lead dioxide layer (which is conventionally used) is directly formed on the tin oxide layer, the adhesion and uniformity of the β-lead dioxide layer and the tin oxide layer are inferior. Thus, in the present invention, an α-lead dioxide layer is formed between the tin oxide layer and the β-lead dioxide layer.

The α-lead dioxide layer can be formed on the tin oxide layer by dissolving (until saturation) a lead monoxide powder (litharge) (30 to 40 g/liter) in an aqueous solution of about 20% sodium hydroxide and carrying out electrolysis using the solution as the electrolytic bath and using the foregoing core material as the anode at a temperature of from 20° to 50° C. and a current density of from 0.1 to 10 A/dm$^2$. The proper thickness of the α-lead dioxide layer is from 10 to 100 μm.

On the surface of the α-lead dioxide layer is further formed a β-lead dioxide layer. There is no restriction on the method of forming the β-lead dioxide layer and a conventional method can be used. For example, a β-lead dioxide layer can be formed on the foregoing α-lead dioxide layer by carrying out electrolysis using a lead nitrate bath having a concentration of at least 200 g/liter as the electrolytic bath and using the core material having formed thereon the α-lead dioxide layer as the anode at a temperature of from 50° to 70° C. and a current density of from 1 to 10 A/dm$^2$, whereby the desired electrolytic electrode can be obtained.

The electrolytic electrode thus produced can be used for electrolysis in not only an ordinary electrolyte but also in a corrosive electrolyte for a long period of time. Also, the electrode produced as described above can effectively be used even in a fluoride-containing electrolyte for a long period of time regardless of the concentration and the kind of the fluoride ions. However, the condition described above greatly increases the electrodeposition strain, and for stabilizing the foregoing β-lead dioxide layer of the electrode produced, by dispersing a stable powder of a ceramic such as tantalum oxide, a fluorine resin, etc., or fibers in the plating bath, the apparent electrodeposition strain is removed, whereby the β-lead dioxide layer can be stabilized.

The following examples are intended to illustrate the present invention but not to limit it in any way. Unless otherwise indicated, all parts, percents, ratios and the like are by weight.

EXAMPLE 1

The surface of a core material of expand mesh made of titanium having a thickness of 1.5 mm was roughened by blasting with iron grids having the largest particle size of 1.2 mm. After activating the surface of the core material by acid pickling in an aqueous 25% Sulfuric acid solution of 80° C. for 2 hours, tin plating was applied thereto using a sulfuric acid series plating bath containing 50 g/liter of stannous sulfate, 100 g/liter of sulfuric acid, 100 g/liter of cresolsulfuric acid, 1 g/liter of β-naphthol, and 2 g/liter of gelatin. By carrying out an electrodeposition at a bath temperature of 25° C. and a current density of 1.5 A/dm$^2$ for 5 minutes, a tin plating layer having a thickness of about 10 μm was formed. The surface of the tin plating layer was coated with a solution prepared by adding chloroplatinic acid to an isopropyl alcohol solution of alkoxytin followed by burning in air at 350° C. for 15 minutes, and the coating-burning steps were repeated 5 times to convert the tin plating layer into a tin oxide layer. The total platinum amount coated was 1 g/m$^2$.

Then, by carrying out electrolysis in an electrolytic bath of 40° C. prepared by saturately dissolving an optical litharge (PbO) in an aqueous solution of 25% sodium hydroxide using the core material having formed thereon the foregoing tin oxide layer at a current density of 1A/dm$^2$ for 2 hours, an α-lead dioxide layer was formed on the surface thereof. Then, by carring out electrolysis using an aqueous lead nitrate solution of 65° C. having a concentration of 800 g/liter (as the electrolyte) using the core material having formed thereon and the α-lead dioxide layer as the anode at a current density of 2 A/dm$^2$ for 8 hours, a β-lead dioxide layer was formed on the α-lead dioxide layer.

When electrolysis was carried out in an aqueous 15% sulfuric acid solution of 60° C. containing 2% hydrogen fluoride using the electrode thus prepared as the anode and a platinum plate as the cathode at a current density of 100 A/dm$^2$, after 3,000 hours, thin cracks formed in the surfaces of the lead dioxide layers but even after 6,000 hours, the electrolysis could be continued with no problem.

On the other hand, when an electrode was prepared in the same manner as above except that a platinum plating layer having a thickness of 1 μm was formed in place of the tin oxide layer and the electrode was used for the electrolysis under the same condition, after 3,000 hours, cracks formed and after 4,000 hours, the core material at the cracked portions was dissolved out, whereby the electrolysis could not be continued.

EXAMPLE 2

A titanium plate of 1.5 mm in thickness was used as a core material, the core material was coated with an aqueous diluted hydrochloric acid solution of titanium tetrachloride and tantalum pentachloride at a ratio of 80 mol % titanium and 20 mol % tantalum and burned at a first burning temperature of 400° C. and thereafter by following the same procedure as in Example 1 except that the coating step and the burning step, at a burning temperature of 520° C., were repeated 5 times. A tin oxide layer was thus formed on the core material.

After forming an α-lead dioxide layer on the tin oxide layer by electrodeposition under the same condition as in Example 1, a β-lead dioxide layer containing a fluorine resin powder was formed on the α-lead dioxide layer under the same condition as in Example 1 except that a dispersion of the fluorine resin powder was added to the aqueous lead nitrate solution.

When electrolysis was carried out using the electrode thus prepared as the anode under the same conditions as in Example 1, after about 3,500 hours, cracks formed but even after 6,000 hours, the electrolysis could be continued.

The electrolytic electrode of the present invention is composed of a core material made of a valve metal, a dense tin oxide layer rendered electrical conductive formed on the surface of the core material, an α-lead dioxide layer formed on the tin oxide layer, and a β-lead dioxide layer formed on the α-lead dioxide layer.

In the electrolytic electrode having the construction as described above, even if cracks form in the uppermost β-lead dioxide layer, the permeation of an electrolyte into the core material is prevented by the α-lead dioxide layer and the tin oxide layer as the inside layers thereof and the life of the electrode is prolonged.

The tin oxide layer prevents the impregnation of an electrolyte into the core material but since tin oxide itself is frequently inferior in the electric conductivity and for improving the electric conductivity of the tin oxide layer, it is preferred to add a fluoride, platinum, antimony, titanium, tantalum, niobium, etc., to the tin oxide layer.

As described above, the electrolytic electrode of the present invention is particularly useful as an electrode in fluoride-containing electrolysis but on the other hand, the electrodeposition strain is liable to be increased. For preventing the increase of the electrodeposition strain, the β-lead dioxide layer may be stabilized by dispersing a ceramic powder and/or a fluorine resin powder in the β-lead dioxide layer.

Also, by the production method of the electrolytic electrode according to the present invention, a tin plating layer is formed on the surface of a core material made of a valve metal, coating-oxidizing steps of coating a liquid containing an electrically conductive substance on the tin plating layer and oxidizing it by thermal decomposition are repeated to convert the tin plating layer into a dense tin oxide layer rendered electrical conductive, an α-lead dioxide layer is formed on the tin oxide layer, and then a β-lead dioxide layer is formed on the α-lead dioxide layer.

In the electrolytic electrode mainly composed of lead dioxides as in the present invention, even if cracks form in the uppermost β-lead dioxide layer, the permeation of the electrolyte into the core material is prevented by the α-lead dioxide layer and the tin oxide layer as the inside layers thereof, whereby the life of the electrode is prolonged. Since it is difficult to directly form a dense tin oxide layer on the core material made of a valve metal, in the present invention, a tin plating layer is first formed on the core material and by oxidizing the tin plating layer, a tin oxide layer is formed. However, since as described above, the tin oxide layer itself is inferior in the electric conductivity, in the method of the present invention, a salt of titanium, tantalum, niobium, etc., tin, antimony, a fluoride, platinum, etc., is added on the tin plating layer at the oxidation step followed by thermal decomposition, etc., a dense tin oxide layer having an electrical condictivity can be formed on the core material with a good efficiency.

While the invention has been described in detail and with reference to specific embodiments thereof, it will be apparent to one skilled in the art that various changed and modifications can be made without departing from the spirit and scope thereof.

What is claimed is:

1. A method of producing an electrolytic electrode comprising the steps of:

electrodepositing a tin plating layer on a surface of a core material wherein said core material is made of a valve metal, coating an electrically conductive substance on the tin plating layer and oxidizing by thermal decomposition wherein said coating and oxidizing steps are repeatedly performed and convert the tin plating layer into a dense electrically conductive tin oxide layer, electrodepositing an α-lead dioxide layer on the dense electrically conductive tin oxide layer, and electrodepositing a β-lead dioxide layer on the α-lead dioxide layer.

2. The method of claim 1, wherein the tin plating layer has a thickness of from 1 to 20 μm.

* * * * *